US006435922B2

(12) United States Patent
Keiser et al.

(10) Patent No.: US 6,435,922 B2
(45) Date of Patent: Aug. 20, 2002

(54) ELECTRICAL CONNECTOR

(75) Inventors: Markus Keiser, Reitnau; Peter Wagner, Oetwil a.d.I., both of (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/865,671

(22) Filed: May 29, 2001

(30) Foreign Application Priority Data

Jun. 14, 2000 (FR) ..... 00 07570

(51) Int. Cl.[7] ..... H01R 13/187
(52) U.S. Cl. ..... 439/816; 439/841; 439/842
(58) Field of Search ..... 439/816, 827, 439/86, 839, 843, 825, 842, 844, 845, 846, 847, 848

(56) References Cited

U.S. PATENT DOCUMENTS 3,861,595 A 1/1975 Deal
3,861,776 A * 1/1975 Deal ..... 339/74
4,083,622 A * 4/1978 Neidecker ..... 339/256

FOREIGN PATENT DOCUMENTS

| | | | |
|---|---|---|---|
| DE | 26 33 892 | 5/1977 | ..... H01R/13/12 |
| EP | 0 716 474 | 6/1996 | ..... H01R/13/24 |

* cited by examiner

*Primary Examiner*—P. Austin Bradley
*Assistant Examiner*—Alexander Gilman
(74) *Attorney, Agent, or Firm*—Sughrue Mion, PLLC

(57) ABSTRACT

A cylindrical coaxial electrical connector comprising a male portion and a female portion, the connector being of the type that includes an intermediate strip of contact springs of elastic material, the springs being united at their ends by two continuous side strips and each having a succession of tongues extending the side strip outwards, said intermediate strip being placed in an annular housing in one or other of the two portions, said housing having two side flanks with walls that are perpendicular to the axis of the connector, wherein each elastic tongue has a first face bent towards the bottom of the housing and then bent in the opposite direction to form an end face rising up towards the outside of the housing, the end of said face bearing against the side flank of said annular housing.

4 Claims, 2 Drawing Sheets

ELECTRICAL CONNECTOR

The present invention relates to a cylindrical coaxial electrical connector comprising a male portion and a female portion, and of the type having an intermediate strip of contact springs placed in an annular housing in one of the two portions.

The invention applies in particular, although in non-limiting manner, to contacts for passing permanent currents in high voltage and medium voltage switchgear.

BACKGROUND OF THE INVENTION

Contact springs are made of punched metal strip material. They are parallel to one another like the rungs of a ladder and they are therefore connected at each end to respective continuous side strips. Each side strip also has lobes or "tongues" e.g. in the form of isosceles trapeziums which are bent out from the plane of the strip. To mount the strip, the portion which receives it, e.g. the male portion, has an annular housing with side flanks that slope so as to form a dovetail-shape. The above-mentioned tongues thus are brought to bear against these side flanks. However in order to insert the strip into the annular housing of dovetail-section, it is necessary to make a transverse strip-insertion slot. In order to avoid this additional machining, which is necessary for inserting the strip, it is known to place the strip in an annular housing whose flanks are at right angles or slope slightly but towards the inside, and to retain the strip in the housing by means of two resilient rings, one on each side of the strip and bearing radially against the tongues of the side strips. That solution is not satisfactory since the pressure exerted is not uniform over the entire circumference of the ring and there is a risk of the strip of contact springs being held poorly.

OBJECT AND SUMMARY OF THE INVENTION

An object of the present invention is to mitigate those drawbacks, and the invention provides a cylindrical coaxial electrical connector comprising a male portion and a female portion, the connector being of the type that includes an intermediate strip of contact springs of elastic material, the springs being united at their ends by two continuous side strips and each having a succession of tongues extending the side strip outwards, said intermediate strip being placed in an annular housing in one or other of the two portions, said housing having two side flanks with walls that are perpendicular to the axis of the connector, wherein each elastic tongue has a first face bent towards the bottom of the housing and then bent in the opposite direction to form an end face rising up towards the outside of the housing, the end of said face bearing against the side flank of said annular housing.

BRIEF DESCRIPTION OF THE DRAWINGS

An embodiment of the invention is described below with reference to the accompanying drawings, in which.

MORE DETAILED DESCRIPTION

Figure 1:
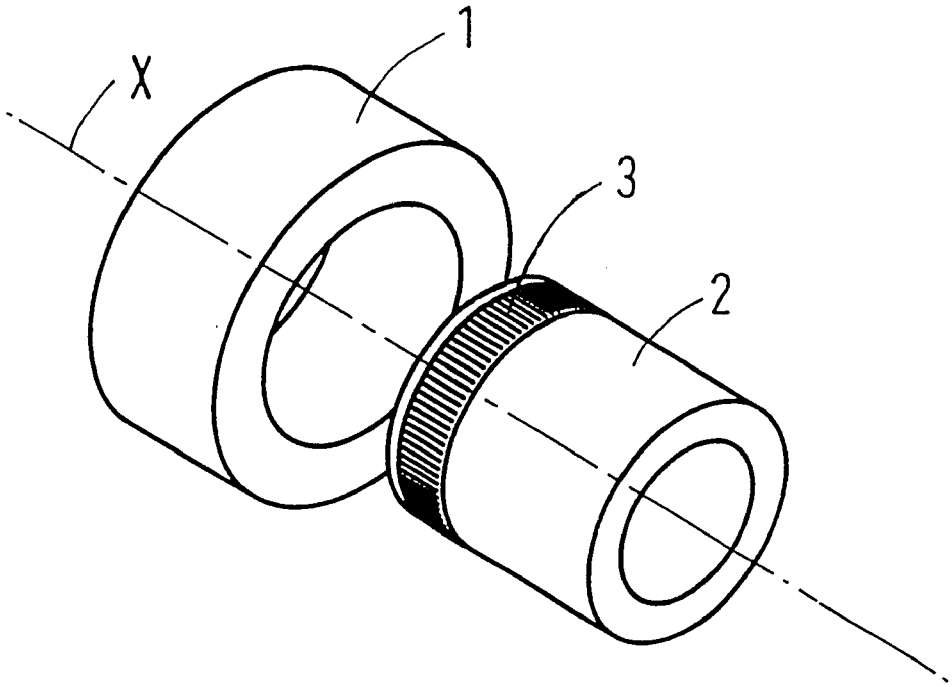
FIG. 1 is a diagrammatic perspective view of an electrical connector of the invention.

With reference to FIG. 1, there can be seen a diagram of a cylindrical coaxial electrical connector comprising a female portion 1 and a male portion 2. The male portion 2 is fitted with an intermediate strip 3 of contact springs. This intermediate strip 3 is made of an elastic material that has resilient properties. It is disposed in an annular housing in the male portion 2.

In the example shown, it is the male portion which receives the intermediate strip of contact springs, however the opposite configuration is also possible.

Figure 2:
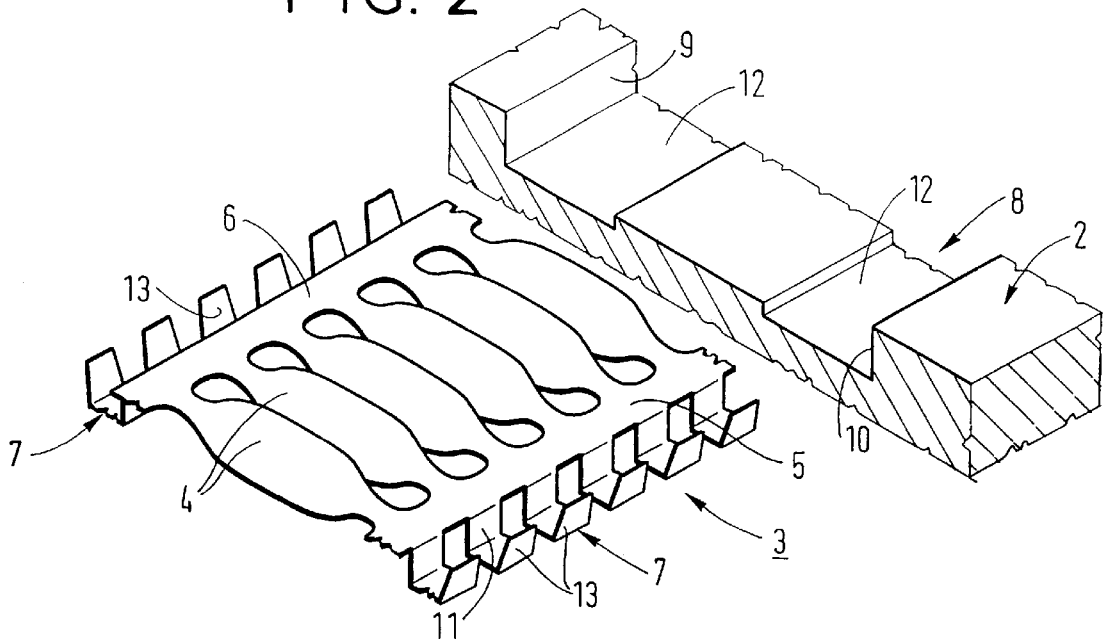
FIG. 2 is on a larger scale, and shows separately a part of the intermediate strip of contact springs and a part of the male portion of the electrical connector, depicting the shape of the annular housing in which the intermediate strip of contact springs is to be placed.
Figure 3:
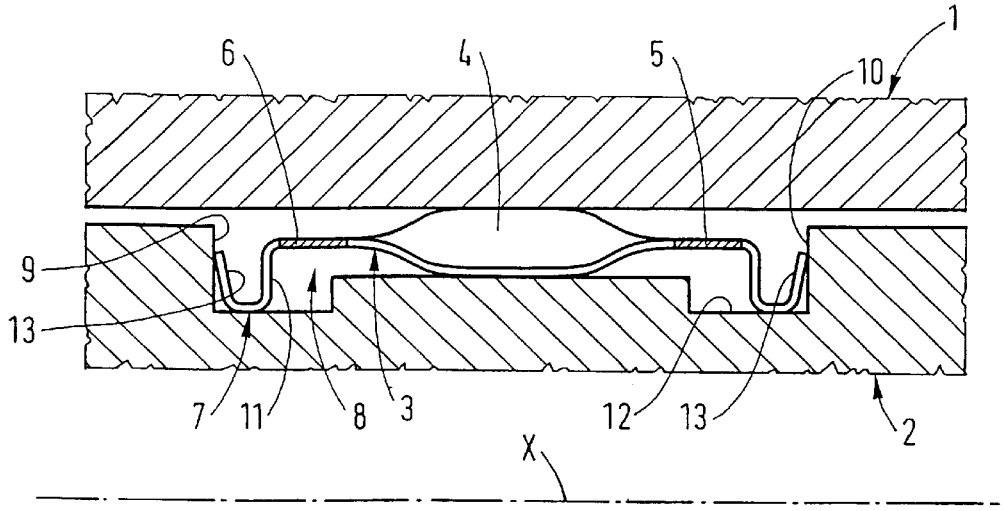
FIG. 3 is a fragmentary section view of the electrical connector showing the intermediate strip in its housing, and showing the male portion of the connector situated inside the female portion.

With reference now to FIGS. 2 and 3, there follows a description of the particular features of the intermediate strip and of the housing for said strip.

FIG. 2 shows a part of the intermediate strip 3. It has contact springs 4 which are united at their ends by continuous side strips 5 and 6. The side strips 5 and 6 have tongues 7 that extend the strip outwards.

This intermediate strip 3 is made of an elastic material having resilient properties. Prior to the treatment that imparts said elastic properties to the spring, the strip is punched, the springs 4 are twisted, and the tongues are bent into the desired shape.

To put the intermediate strip 3 of contact springs into place, the male portion 2 has an annular housing 8 with two side flanks 9 and 10. These side flanks 9 and 10 are plane and perpendicular to the axis X of the connector (see FIGS. 1 and 3).

As shown clearly in FIGS. 2 and 3, the elastic tongues 7 form springs like the intermediate strip 3 as a whole, with a first face 11 bent down towards the bottom 12 of the housing 8 followed by a bend in the opposite direction to form an end face 13 that rises towards the outside of the housing 8.

In position, as shown in FIG. 3, the face 13 has its end bearing against the flank 9 (or 10) of the housing 8.

The angle between said face 13 on each tongue 7 and the flanks 9 or 10 is an acute angle.

Thus, it is easy to insert the strip into its housing and the strip is securely held therein without requiring any additional part, because of the spring effect produced by the tongues 13 against the flanks 9 and 10. The faces 13 of the tongues whose ends are directed towards the outside of the housing bear against the flanks 9 and 10 at an acute angle, thus forming a self-locking system that opposes removal of the intermediate strip.

What is claimed is:

1. A cylindrical coaxial electrical connector comprising:

a male portion;

a female portion into which the male portion is inserted; and an intermediate strip of contact springs of elastic material, the springs being united at their ends by two continuous side strips from which a succession of tongues extends in an outward direction, the intermediate strip being placed in an annular housing provided in one of the male portion and the female portion, the housing having at least two internal side walls that are perpendicular to the axis of the connector, wherein each elastic tongue has a first face bent towards the bottom of the housing and an end face extended from the first face and bent in the opposite direction and rising up towards the outside of the housing, the end of the end face bearing against at least one of the two side walls of the annular housing.

2. An electrical connector according to claim 1, wherein the end face on each of the tongues is at an acute angle with the at least one of the two side walls.

3. A cylindrical coaxial electrical connector comprising:

a male portion;

a female portion into which the male portion is inserted;

an annular housing provided in one of the male portion and the female portion, the housing having at least two internal side walls that are perpendicular to the axis of the connector; and a strip of contact springs placed in the housing, the springs being united at their ends by two continuous side strips from which a succession of tongues extends, wherein each tongue has a first portion extending towards a bottom of the housing and a second portion extending from the first portion and away from the bottom of the housing, the second portion bearing against at least one of the two side walls.

4. An electrical connector according to claim 3, wherein the second portion on each of the tongues forms an acute angle with the at least one of the two side walls.

* * * * *